United States Patent [19]

Bernat

[11] 4,319,800

[45] Mar. 16, 1982

[54] BARRIER FOR MOLDED FEMALE POWER CORD CONNECTOR BODIES

[75] Inventor: Charles A. Bernat, Jewett City, Conn.

[73] Assignee: Triangle PWC, Inc., New Brunswick, N.J.

[21] Appl. No.: 128,165

[22] Filed: Mar. 7, 1980

[51] Int. Cl.[3] ..... H01R 4/24

[52] U.S. Cl. ..... 339/218 R

[58] Field of Search ..... 339/62, 63 R, 63 M, 339/218 R, 218 M, 218 C, 218 L, 218 S, 65, 66, 191–193

[56] References Cited

U.S. PATENT DOCUMENTS

| | | | |
|---|---|---|---|
| 2,701,867 | 2/1955 | Obenschain et al. | 339/218 M X |
| 3,665,239 | 5/1972 | Morinaud | 339/218 R X |
| 3,945,708 | 3/1976 | Griffin | 339/218 R X |

FOREIGN PATENT DOCUMENTS

| | | | |
|---|---|---|---|
| 2428252 | 1/1976 | Fed. Rep. of Germany | 339/218 R |

*Primary Examiner*—Joseph H. McGlynn
*Assistant Examiner*—Frank H. McKenzie, Jr.
*Attorney, Agent, or Firm*—Darby & Darby

[57] ABSTRACT

An improved rigid dielectric barrier of the type utilized in molded-on female connectors for electrical power cords. The barrier has a plurality of passages which are adapted to allow insertion of appropriate prongs of a complementary male connector into contact with the corresponding female contact member. In a preferred embodiment of the invention the barrier is provided with protrusions adjacent to the edges of the passages which make contact with the inside surfaces of the female contact members. The close contact between the protrusions and the female contact members prevents molding compound from seeping into contact with the inside surfaces of the female contact members during the process of molding the connector.

9 Claims, 3 Drawing Figures

BARRIER FOR MOLDED FEMALE POWER CORD CONNECTOR BODIES

This application relates to integrally molded female connectors such as those utilized in power supply cords and extension cord sets and more particularly to an improved design of the rigid dielectric barriers utilized in such connectors.

Presently available electrical power supply cords and extension cord sets frequently are terminated by connectors which are integrally molded to the ends of the cord. Molded connectors of this type are frequently "polarized." A polarized female connector is adapted to accept only a correspondingly polarized male connector having terminal blades or prongs each of which has a unique shape or unique dimensions. Each of the openings of the female connector is configured similarly to its corresponding male connector blade and a female contact member is molded into the connector in alignment with each of the openings. Thus, each of the male contact blades or prongs may be inserted only into the correspondingly configured female connector opening and is consequently allowed to make contact with only a particular female contact member.

According to an Underwriter's Laboratories standard, a female molded-on cord connector body of the type described above must incorporate a rigid barrier having slots conforming to the dimensions of the corresponding male contact blades. This barrier provides protection against the insertion of an incorrect male contact blade or ground pin "into any female contact opening so that it might contact live parts." To conform to the U.L. standard the barrier must be "molded securely within the body of the cord connector body, at a depth sufficient to accomplish its desired purpose." In practice, the barrier is usually molded into the female connector in a position directly in front of the female contact members.

A typical manufacturing process for the production of such a molded-on female cord connector is as follows. The barrier, which may be formed of an elastomeric, thermoplastic or other rigid insulating material, is appropriately positioned in a mold along with the female contact members which have been preconnected to their corresponding conductors in the electrical cord. A thermoplastic or thermosetting compound is then injected into the mold under heat and pressure to form the connector body. Such a process can result in a satisfactory product assuming that the components of the connector body are properly designed, all of the parts are properly placed into the mold and proper molding techniques are employed. Moreover, under some circumstances, the injection pressure of the molding compound may increase beyond its nominal value. Under such conditions, the injected compound may seep through void areas between the barrier and the female contact blades and form an insulating coating on portions of the blades. This compound seepage which is known as "flashing" can thereby prevent the physical contact between the male and female terminals which is necessary for a satisfactory electrical connection. Moreover, in a connector in which such flashing has occurred, the male connector blades may be allowed to come in the immediate vicinity of the female blades without actually contacting them. Such a condition can result in an electrical current flash-over or arc between the male and female blades. The heat generated by this arcing may cause electrical shorts which present an obvious fire danger.

Because of the dangers presented by an improperly molded connector, it is common practice to visually inspect each of the finished connectors and to reject those units which exhibit the results of compound seepage. Some of the rejected units may be salvaged by physically removing the compound from the contacts. Other units must be scrapped, however, and the rejection rate may add significantly to the cost of producing the product. Moreover, some of the dangerously defective units may pass through factory inspection and reach the marketplace.

GENERAL DESCRIPTION OF THE INVENTION

In accordance with the present invention an improved barrier is provided which overcomes the above problems by providing means for preventing molding compound from seeping into contact with the connector blades of a molded female connector even when the connector is molded under less than ideal conditions. To accomplish this purpose an illustrative embodiment of the barrier of the present invention is provided with angular projections which extend from the surface of the barrier which is meant to be placed adjacent to the female contact blades. These projections are adjacent to the slots in the barrier which accept the prongs or contact blades of the complementary male connector. To manufacture a connector in accordance with the invention, the above barrier is positioned in a mold with the female contact members so that the projections of the barrier make contact with end portions of the contact blades of the respective female contact members. The protrusions thus act to fill any voids between the female contact blades and the barrier and thereby prevent any seepage of molding compound during the subsequent molding process. The barrier is formed of a rigid insulating material which is preferably transparent so as to allow visual inspection of the contact blades of the finished product.

A particularly advantageous feature of the present invention is, therefore, the means provided for preventing seepage of molding compound into the contact blades of a molded female connector when the pressure under which the molding compound is injected into the mold is abnormally high.

A further advantageous feature of the present invention is its provision for allowing visual inspection of the contacts of the finished product.

Another advantageous feature of the present invention is its provision of a rigid barrier for molded-on female connectors which meets the requirements set forth by Underwriters Laboratories and which at the same time avoids the flashing problems associated with previous barriers conforming to the Underwriters Laboratories requirements.

It is accordingly an object of the present invention to provide a rigid barrier for a molded-on female electrical connector which prevents molding compound from seeping into the contact blades of the connector during the molding process thereof.

It is a further object of the invention to reduce the number of such connectors which must be scrapped as a result of defects caused by flashing during the molding process.

It is a still further object of the invention to allow for the production of molded-on female connectors which are of superior quality compared to currently acceptable connectors.

It is yet a further object of the present invention to minimize the possibility that dangerously defective connectors will enter the marketplace.

DETAILED DESCRIPTION

This invention is defined with particularity in the appended claims. An understanding of the above and further objects and advantages of this invention may be obtained by referring to the following description in conjunction with the appended drawings in which:

Figure 1:
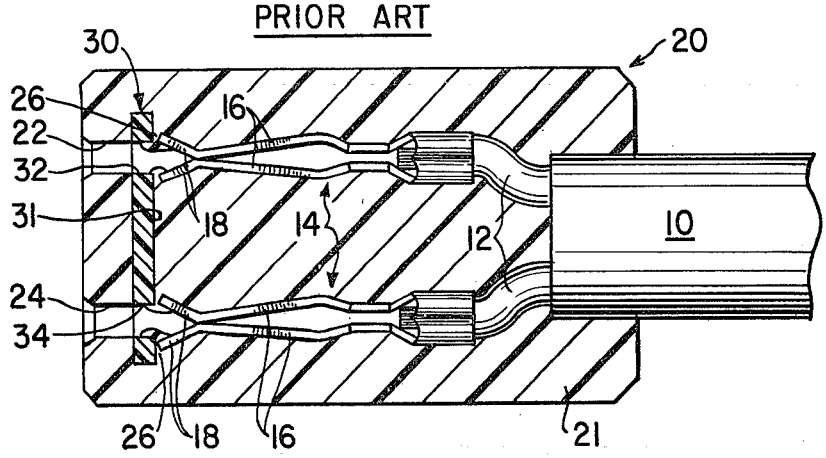
FIG. 1 PRIOR ART
FIG. 1 is a side view of a molded-on female connector in accordance with the prior art with portions broken away.

FIG. 1 illustrates a typical female connector 20 of the prior art which is molded to a power cord 10. As shown by FIG. 1 the conductors 12 of power cord 10 are connected to respective female contact members 14. Each of the contact members 14 includes a pair of female contact blades 16 which have angled end portions 18 for facilitating the insertion therebetween of the prongs of a corresponding male connector (not shown). A rigid barrier 30 in which is formed a slot 32 and a slot 34 is positioned in front of female contact terminals 14 so that each of the slots 32 and 34 is aligned with the space formed between the angled end portions 18 of the respective pair of contact blades 16. The body 21 of connector 20 is molded to form openings 22 and 24 which are aligned with slots 32 and 34 to allow insertion of male prongs into the connector 20 to make electrical contact with the blades 16 of the contact members 14.

It will be noted that, in the areas indicated by reference numeral 26, spaces or voids may exist between the contact blades 16 and the inner surface 31 of the barrier 30. FIG. 1 also shows that during the process of molding the connector 20, portions of the molding compound forming the body 21 of the connector 20 have seeped through these voids 26 to cover portions of the interior surfaces of the contact blades 16. As previously mentioned, these electrically non-conductive portions of molding compound may prevent adequate contact from being obtained between the male prongs and the female contact blades 16.

Figure 3:
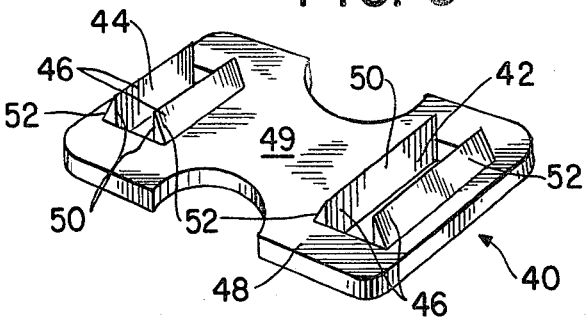
FIG. 3 is a perspective view of a barrier in accordance with the present invention.

FIG. 3 shows an illustrative embodiment of a barrier 40 in accordance with the present invention. The embodiment of the barrier 40 illustrated by FIG. 3 is adapted for incorporation in a female connector which is designed to accept a polarized male connector having two prongs of rectangular cross-section in which the length of the cross-section of one of the prongs is greater than the length of the cross-section of the other prong. The barrier 40 of FIG. 3 has a main body 48 which has a relatively large passage 42 to accept the larger prong and a smaller passage 44 to accept the smaller prong. The passage 42 has a length which is slightly greater than the length of the cross-section of the larger of the male prongs and the passage 44 has a length which is slightly greater than the length of the cross-section of the smaller of the prongs but less than the length of the larger prong's cross-section. Passage 44 is thus adapted to accept only the smaller of the two prongs and improper insertion of the prongs of the male connector into the female connector is thereby prevented.

Adjacent each of the longitudinal edges of passages 42 and 44 is an angular protrusion 46 which extends from the inner surface 49 of the main body. Each of the protrusions 46 is formed to have an inner face 50 which is an extension of the corresponding longitudinal edge of the passage to which the protrusion is adjacent. Each protrusion 46 also has an outer face 52 which makes an acute angle with its inner face 50. In a presently preferred embodiment this angle is in the order of approximately 25 degrees.

Figure 2:
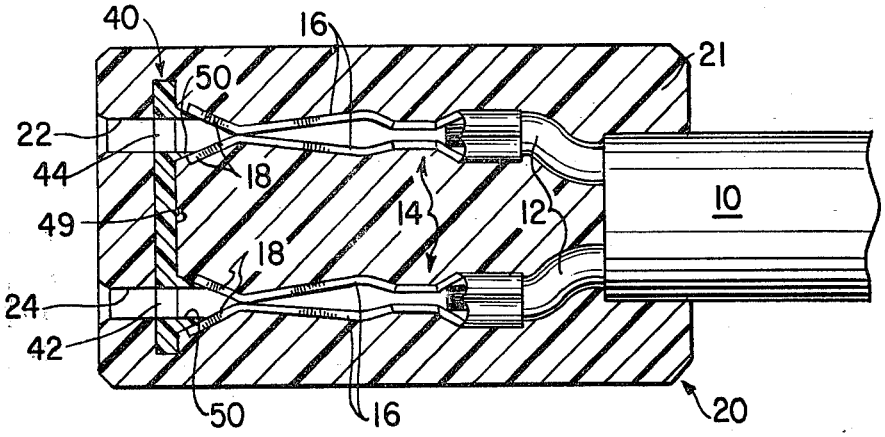
FIG. 2 is a side view of a molded-on female connector in accordance with the present invention with portions broken away.

To manufacture a molded female connector in accordance with the present invention, the barrier 40 is positioned within an appropriate mold with female contact members 14 which have been pre-connected to the conductors 12 of a power cord 10 (see FIG. 2). The barrier is positioned so that the outer faces 52 of its protrusions 46 make contact with the inside surfaces of the angled end portions 18 of the corresponding female contact blades 16.

As will be appreciated from FIG. 2, the protrusions 46 act to fill any spaces which may otherwise have existed between the female contact blades 16 and the inner surface 49 of the barrier 40. During the process of molding the connector 20, therefore, the protrusions 46 of the present invention prevent any seepage of flashing of the molding compound into the inside surfaces of the female contact blades 16. The protrusions 46 should extend a sufficient distance from the inner surface 49 of the barrier 40 so that the outer faces 52 of the protrusions will make contact with the corresponding inner surfaces of the angled end portions 18 of the female contact blades 16 regardless of any minor variations in the distance between the contact blades 16 and the inner surface 49. Thus the barrier 40 of the present invention prevents seepage of molding compound into the inner surfaces of the female contact blades 16 during the molding process.

The barrier 40 may be formed of any convenient rigid electrical insulating material such as nylon, Tenite II or polypropylene. Preferably however, the material utilized is transparent or nearly transparent. The use of such an essentially transparent material allows the inside surfaces of the female contact blades 16 to be visually inspected through the openings 22 and 24 of a finished connector.

The barrier 40 described above may be incorporated in a female connector which is adapted to accept a corresponding male connector having a typical two-pole polarized configuration. It will be readily appreciated, however, that the barrier may be configured to accept corresponding male connectors of any other standard configuration without departing from the spirit and scope of the invention. For example, the barrier may have passages which are circular or irregularly shaped to correspond to the cross-sections of additional male terminals such as a ground prong. Where these passages are rectangularly shaped, such as illustrated by FIG. 3, it is believed that it is necessary to provide protrusions 46 which are adjacent only to the longitudinal edges of the passages. For a circular or irregularly shaped passage, on the other hand, it may be preferable to provide angular protrusions which completely surround the edges of the passage.

It will be understood, therefore, that the foregoing description of a preferred embodiment of the present invention is for purposes of illustration only, and that various structural features as herein disclosed are susceptible to a number of modifications and changes none of which entail any departure from the spirit and scope of the present invention as defined in the hereto appended claims.

What is claimed is:

1. In a rigid dielectric barrier adapted for incorporation in a front portion of a molded female electrical connector for preventing improper insertion of a prong of a complementary male connector into said female connector, said female connector including a plurality of female contact members, each of said contact members corresponding to one of said prongs and having a front portion adapted to accept its corresponding prong, and said barrier having a passage corresponding to the front portion of each said female contact member and adapted to be aligned therewith, each said passage being dimensioned to closely accept the corresponding prong for allowing said corresponding prong to be inserted into the front portion of said corresponding female contact member, the improvement comprising:

a protrusion adjacent an edge of each said passage adapted for being placed in contact with an interior surface of the front portion of said corresponding female contact member prior to and during the molding of said female connector for preventing molding compound from seeping into contact with said interior surface.

2. A barrier in accordance with claim 1 wherein said protrusion has an inner face formed as an extension of said edge and an outer face which meets said inner face at an acute angle.

3. A barrier in accordance with claim 2 wherein said acute angle is approximately 25°.

4. A barrier in accordance with claim 1 and formed of an essentially transparent dielectric material.

5. A molded female electrical connector comprising:

a plurality of female contact members each having a front portion adapted to accept a corresponding prong of a complementary male connector;

a rigid dielectric barrier positioned directly forward of said front portions and having formed therein a plurality of passages, each said passage being in alignment with a corresponding one of said front portions, said barrier including a protrusion adjacent an edge of each said passage, each said protrusion contacting an inner surface of the corresponding front portion; and a body of dielectric material molded over and surrounding said barrier and said female contact members and formed with a plurality of front openings, each said opening being longitudinally aligned with a corresponding one of said passages for allowing insertion of said corresponding prong therethrough.

6. A connector in accordance with claim 5 wherein each said protrusion includes:

an inner face forming an extension of its adjacent passage edge; and an outer face meeting said inner face at an acute angle and contacting said inner surface of the corresponding front portion.

7. A connector in accordance with claim 6 wherein said acute angle is approximately 25 degrees.

8. A connector in accordance with claim 5 wherein said barrier is formed of an essentially transparent material for allowing visual inspection of said front portion inner surfaces through said front openings.

9. Apparatus according to claim 1 or 5 wherein said barrier is substantially planar.

* * * * *